United States Patent [19]

Slagle, Jr. et al.

[11] Patent Number: 4,585,213

[45] Date of Patent: Apr. 29, 1986

[54] WELL DERRICK

[75] Inventors: Grady M. Slagle, Jr., Dallas; Raymond J. Swaim, Arlington, both of Tex.

[73] Assignee: Armco Inc., Middletown, Ohio

[21] Appl. No.: 638,426

[22] Filed: Aug. 7, 1984

[51] Int. Cl.[4] ..... B66D 3/08; B66C 23/60

[52] U.S. Cl. ..... 254/386; 254/394; 254/399

[58] Field of Search ..... 254/386, 394, 399, 392

[56] References Cited

U.S. PATENT DOCUMENTS

| | | | |
|---|---|---|---|
| 1,973,197 | 9/1934 | Baker | 254/386 X |
| 3,474,924 | 10/1969 | Wheeler | 254/386 X |
| 3,653,635 | 4/1972 | Bates | 254/392 |
| 3,792,836 | 2/1974 | Bender | 254/386 X |
| 3,940,111 | 2/1976 | Castela | 254/392 X |
| 4,128,229 | 12/1978 | Elliston | 254/399 |
| 4,341,373 | 7/1982 | Mouton | 254/386 |

*Primary Examiner*—Stuart S. Levy
*Assistant Examiner*—Katherine Matecki
*Attorney, Agent, or Firm*—Roylance, Abrams, Berdo & Goodman

[57] ABSTRACT

Well derrick in which the travelling crown block is operated by hydraulically operated linear actuators and a travelling block is operated by special reeving, the arrangement advantageously being such that the loads being handled bypass the tower of the derrick so that the cost of the tower can be reduced. The reeving system results not only in uniform and symmetrical force distribution relative to the crown block and travelling beam but also in a travel of the travelling beam twice the stroke of the linear actuators.

40 Claims, 25 Drawing Figures

WELL DERRICK

This invention relates to derricks and particularly to hydraulically powered derricks for hoisting, lowering and suspending drill pipe and casing while drilling a well.

BACKGROUND OF THE INVENTION

Hydraulically powered derricks have long been used for many purposes as shown, for example, by U.S. Pat. Nos. 1,973,197 Baker and 3,474,924 Wheeler. However, as the depths to which wells must be drilled have increased, with a corresponding increase in the loads which must be handled by the derrick, workers in the well drilling art have recognized the need for increasing the strengths and load-handling capacities of well derricks and have proposed more massive and complex derricks as seen, for example, in U.S. Pat. Nos. 4,128,229 Elliston and 4,170,340 Mouton. Though the advantages of such derricks are recognized, there has been a continuing need for improvement, particularly in reducing costs and increasing versatility.

SUMMARY OF THE INVENTION

Derricks according to the invention combine at least two hydraulically operated linear actuators with a specially reeved cable system in such fashion that the derrick can be used in one mode for handling lighter loads, typically drill pipe, in a second mode for handling heavier loads, such as especially long strings of drill pipe and strings of smaller casing, and a third mode for handling especially heavy loads, such as casing of larger diameter. In particularly advantageous embodiments, the loads being handled bypass the tower so that the cost of the tower can be markedly reduced, and multiple actuators are employed in such a manner that, for any particular task to be carried out with the derrick, only the number of actuators required need be employed and wear and horsepower requirements are reduced.

Derricks according to the invention comprise a substructure which includes the drilling floor, the floor defining a drilling opening to be aligned with the well axis, and a tower supported by the substructure and extending upwardly therefrom. A travelling crown block is provided, and the crown block and tower have coacting guide means to restrain the crown block laterally to a predetermined position relative to the well axis while allowing the crown block to move upwardly and downwardly relative to the tower. At least one pair, and advantageously two pairs, of hydraulically operated linear actuators are employed, with each actuator including an elongated hollow cylinder, an elongated rod member telescopically arranged within the cylinder, and means coacting between the cylinder and the rod member in piston fashion. Either the rod members are fixed and the cylinders move or the cylinders are fixed and the rod members move. In particularly advantageous embodiments the rod members have free end portions projecting from the respective cylinders and secured either to the substructure or to an upper end portion of the tower, so that the rod members are fixed against longitudinal movement relative to the substructure and tower while the cylinders are free to move longitudinally in both directions relative to the rod members. Releasable means, advantageously remotely operated, as from the rig floor, secure like ends of the cylinders of the actuators to the crown block. The linear actuators of each pair are arranged each on a different side of the drilling axis. With either one or two pairs of linear actuators employed, the actuators advantageously extend all in a common plane, with that plane including the vertical axis of the crown block, the vertical axis of the crown block being maintained substantially coincident with the well axis.

The crown block carries reeving means comprising four sets of reeving wheels, first and second wheels of the first two sets being located on one side of the crown block and a third wheel of each set being located on the opposite side of the vertical axis of the crown block. First and second wheels of the third and fourth sets of wheels are located on the opposite side of the crown block from the first and second reeving wheels of the first and second sets and, in similar fashion, the third wheels of the third and fourth sets of wheels are each located on the opposite side of the crown block from the third wheel of the first and second sets of wheels. The wheel diameters are such as to permit the vertical centers of all the wheels to be so located as to balance the applied and resultant forces on the crown block about each of two primary horizontal axes, one parallel to the vertical plane containing the linear actuators, the other perpendicular to the plane, when the linear actuators apply either a balanced or an unbalanced upward force to the crown block.

A travelling beam is employed and the derrick comprises cable means for operating the travelling beam, the cable means including for each set of reeving wheels a first cable which can be secured at one end to the substructure via an expansible chamber device, and at the other to the travelling beam, the first cable extending over the first reeving wheel of each set. The cable means also includes a second cable having one end secured to the substructure via an expansible chamber device, and the other to the travelling beam, the second cable extending over both the second and third reeving wheels. The expansible chamber devices of the first and second cables of each set of cables are interconnected to equalize the tension in those two cables. The first cable is connected to the travelling beam in a location which is on the same side of the vertical axis of the crown block as is the vertical actuator while the second cable is connected to the travelling beam at a location on a straight horizontal line extending from the connection of the first cable on the travelling beam, through the well vertical axis, to a location essentially equidistant from the vertical axis on the opposite side of the travelling beam. In similar fashion, the first and second cables of the remaining three sets of cables have one end secured to the travelling beam at locations that are diagonally opposite, on each side of the vertical axis, and spaced at distances that are essentially equal to each other from the vertical axis, the opposite ends of those cables being secured to the substructure. Thus, the cables apply to the travelling beam an upward force which is essentially symmetrical relative to the center of the travelling beam and relative to the well axis, one half of this force being applied to each side of the travelling beam about each horizontal axis, said axes being parallel and perpendicular to the sides of the travelling beam.

When the derrick includes two pairs of linear actuators, smaller loads such as are presented by drill pipe can be handled by energizing only one pair of actuators, the other pair having been disconnected from the crown block. For greater loads, presented by a longer drilling string or by inner or intermediate casing, all four actuators are employed. In both cases the combination of linear actuator spacing, reeving wheel locations and diameters, and equalizing of cable tensions distributes the applied forces to the travelling crown block and the travelling beam in a fashion such that, when coupled with the reaction forces, symmetrical resultant forces are produced even though one or both linear actuators on one side of the well axis may act before or less effectively than those on the opposite side of the well axis. The continual changing of linear actuator effectiveness because of non-constant friction forces may produce continued small variations of the tension in individual cables while a constant overall balance is maintained in the travelling crown block and travelling beam. In each case, the reeving systems not only results in uniform and symmetrical force distribution but also provides a travel of the travelling beam which is twice the stroke of the linear actuators. Thus, if the actuator stroke is 55 ft., the stroke of the travelling beam is 110 ft.

When casing is to be handled in sizes such that the loads can be hoisted, supported and lowered by the crown block, cable means and travelling beam, and the travelling beam is equippped with a power swivel, a conventional casing elevator tool can be suspending from the power swivel to connect to the casing collar. However, the loads presented by outer casing strings may exceed the load capabilities of the combination of the linear actuators, crown block, cable means and travelling beam. Under those circumstances, the crown block and travelling beam are run to the top of the tower and secured to the tower, advantageously by remotely operable means, the crown block is disconnected from the cylinders of the linear actuators, and the actuators are then retracted. A casing beam is then secured to the cylinders of at least one pair of the linear actuators, the casing beam being equipped with its own power swivel and casing elevator. If two pairs of linear actuators are employed and the casing beam is attached to the cylinders of both pairs, simultaneous operation of all four linear actuators will provide a load capacity twice that afforded when all four linear actuators are energized and the force is applied via the cable means and reeving. Applying the invention to the drilling of deep wells, and using two pairs of linear actuators, operation of only two of the actuators with force applied via the cable means can supply a total force of, e.g., 600,000 lbs. to the travelling beam, in which case the force supplied when all four actuators are operated and the force is applied via the cable means will be 1.2 million lbs., and that afforded when a casing beam is secured to the cylinder of all four actuators will be 2.4 million lbs.

IDENTIFICATION OF THE DRAWINGS

DETAILED DESCRIPTION OF THE INVENTION

Substructure and Tower

Figure 2:
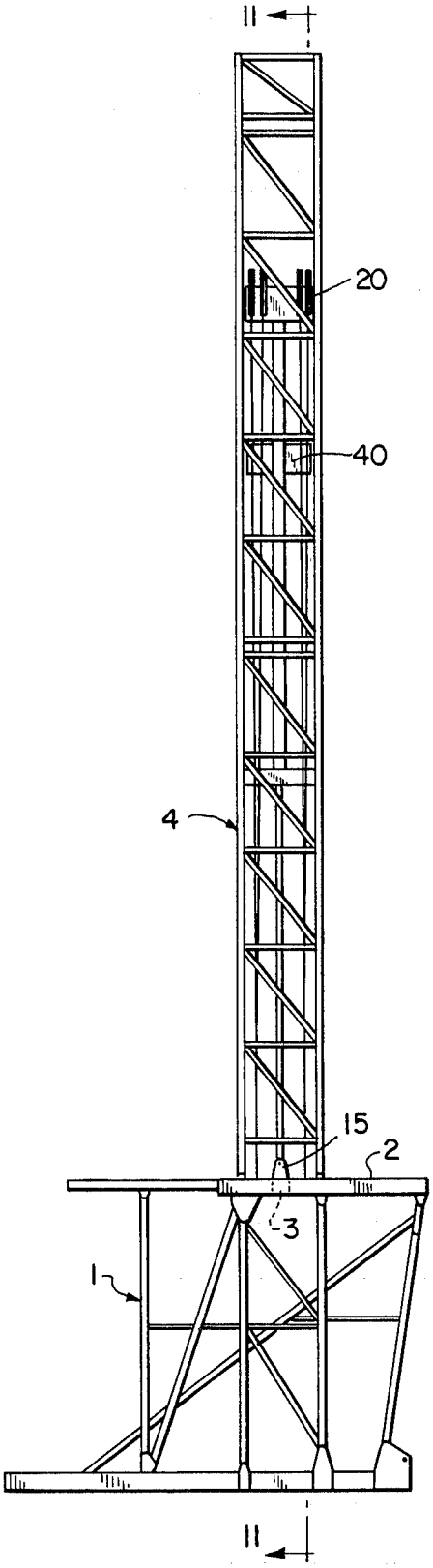
FIGS. 1 and 2 are semi-diagrammatic side elevational views of a well derrick according to one embodiment of the invention.
Figure 1:
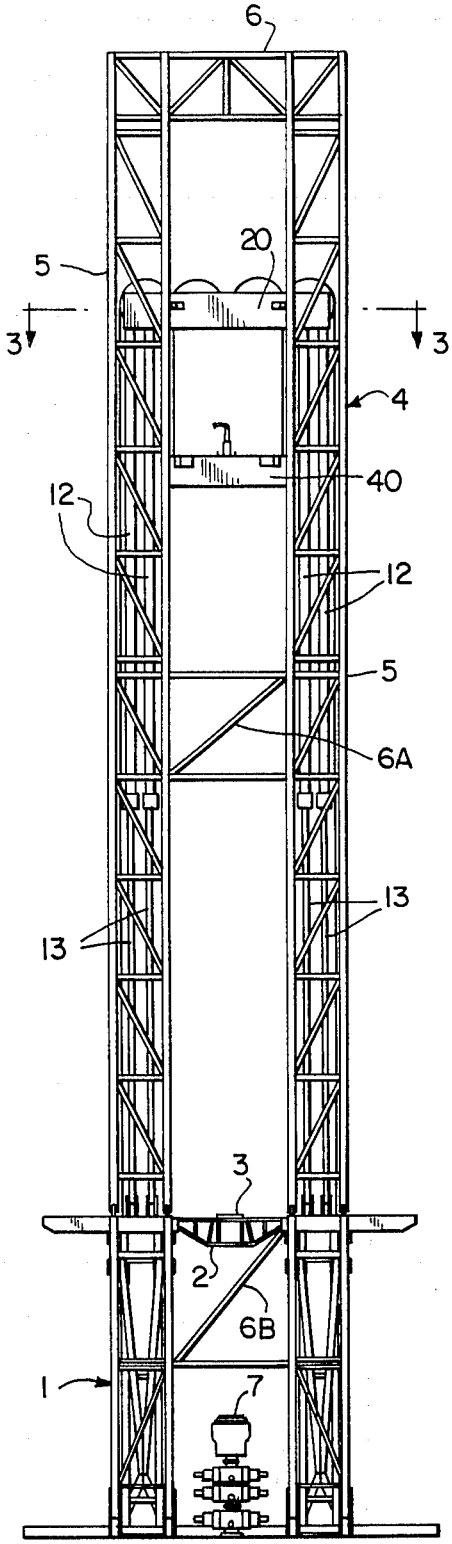
Figure 2A:
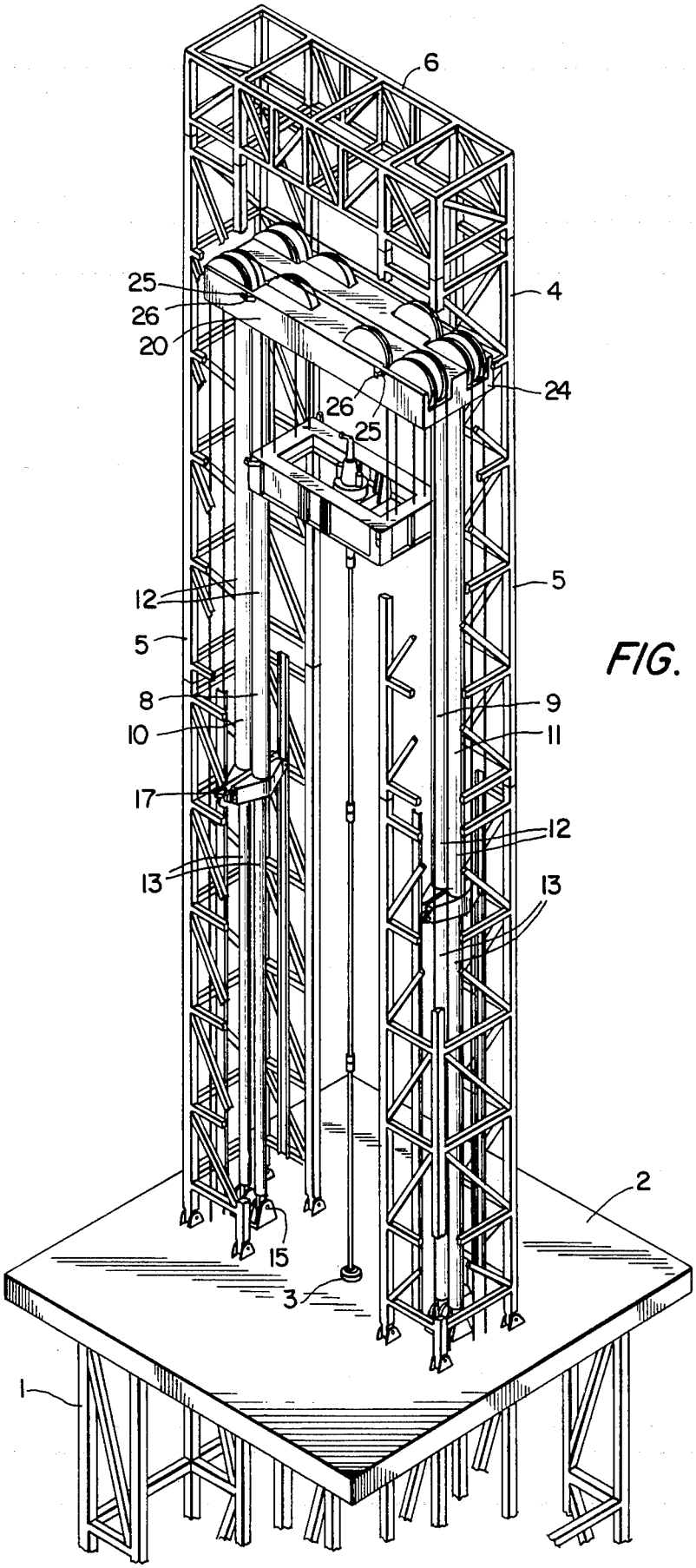
FIG. 2A is a perspective view, with parts broken away for clarity of illustration, of the well derrick of FIG. 1.

Derricks according to FIGS. 1–14A include a substructure 1 which is secured at a base at the well site, the base being on land or offshore. Substructure 1 includes a horizontal drilling floor 2 having a drilling opening 3 concentric with the well axis. Secured to and projecting upwardly from the substructure, tower 4 includes two vertical legs 5 secured at their lower ends to floor 2 and rigidly interconnected at their upper ends by a horizontal upper end structure 6. In a typical installation, floor 2 can be spaced above the base by 36 ft., to give head room for the blow-out preventers 7, and the combined height of the structure and tower can be 175 ft. Interconnecting lateral support structures 6A and 6B are pinned into place at the aft side of tower 4 opposite the pipe handling side of the derrick.

Linear Actuators and Travelling Crown Block

Figure 2B:
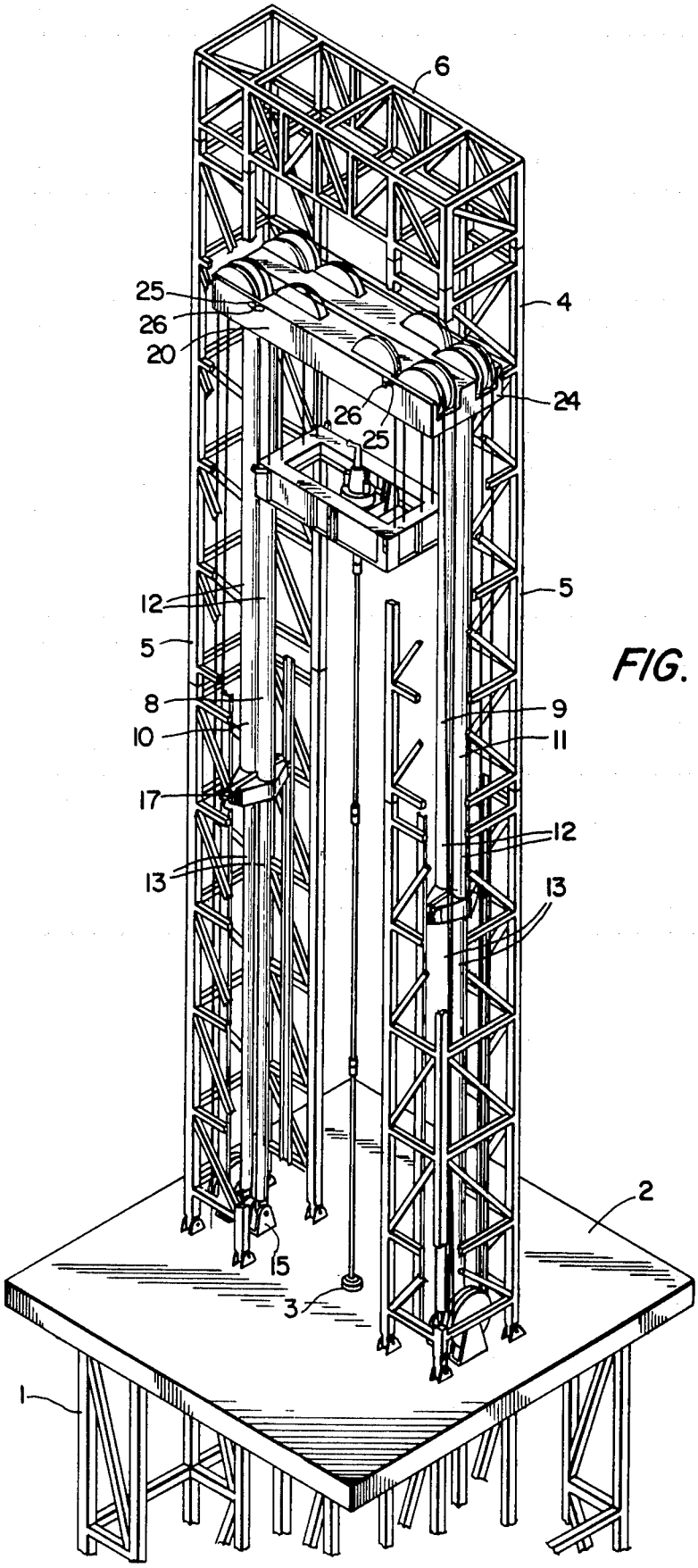
FIG. 2B is a perspective view of another embodiment of the well derrick of FIG. 1.
Figure 6:
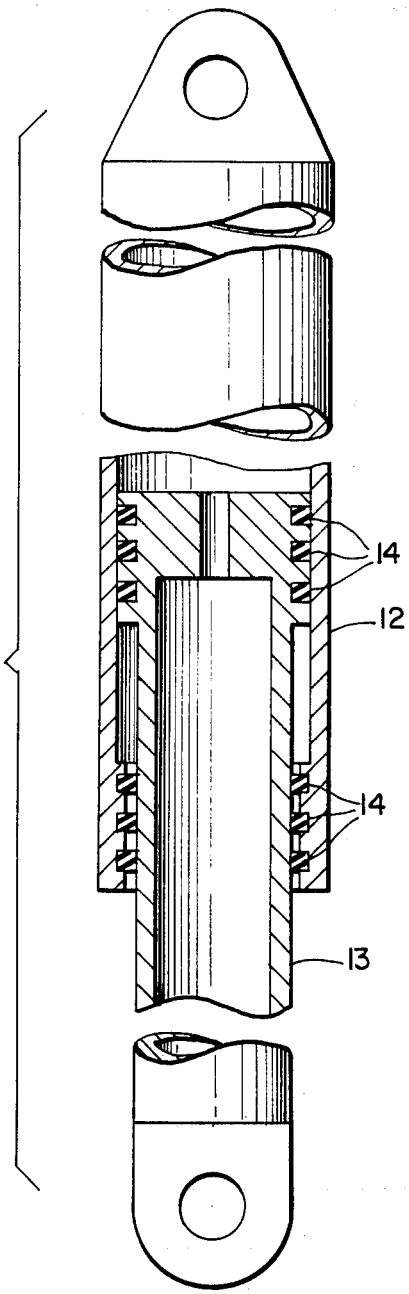
FIG. 6 is a longitudinal cross-sectional view of one form of linear actuator which can be used according to the invention, with the rod under compression during hoisting.
Figure 6A:
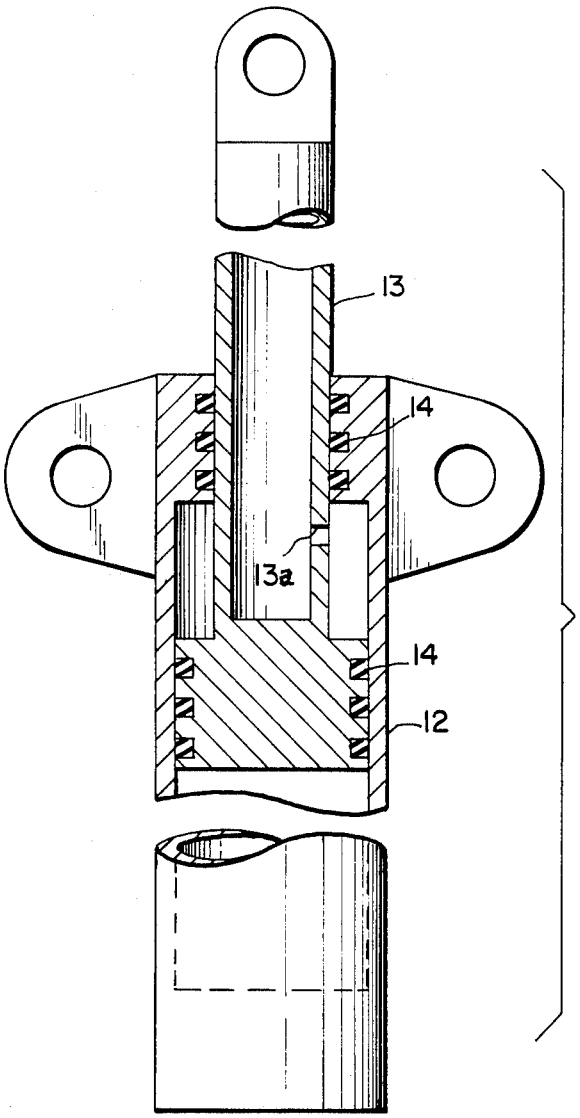
FIG. 6A is a view similar to FIG. 6 of another form of linear actuator in which the rod is under tension during hoisting.

Two pairs of hydraulically powered linear actuators are employed, the first pair consisting of actuators 8 and 9, the second pair consisting of actuators 10 and 11. Each actuator comprises an elongated hollow cylinder 12, an elongated tubular rod member 13 telescopically engaged within the cylinder, and means coacting between the cylinder and rod member as a piston. When the linear actuators are to be in compression during hoisting, as in the embodiments of FIGS. 1–2B, the piston means can comprise an enlargement at the inner end of rod member 13 and a plurality of seal members 14, FIG. 6, each disposed in a different one of a plurality of grooves in the enlargement and slideably engaging the inner wall of cylinder member 12, additional seal members 14 being provided to seal between the free end of the cylinder member and the outer surface of the rod member, pressure fluid being supplied via the bore of the rod member and an axial port at the inner end of the rod member. When the linear actuators are to be in tension during hoisting, as in the embodiment of FIGS. 14 and 14A, the enlargement which forms the piston means completely closes the bore of the rod member, so that the expansible chamber of the actuator is between the piston means and the end of the cylinder member through which the rod member passes, and pressure fluid is supplied from the bore of the rod member via a lateral port 13*a*, FIG. 6A.

Figure 3:
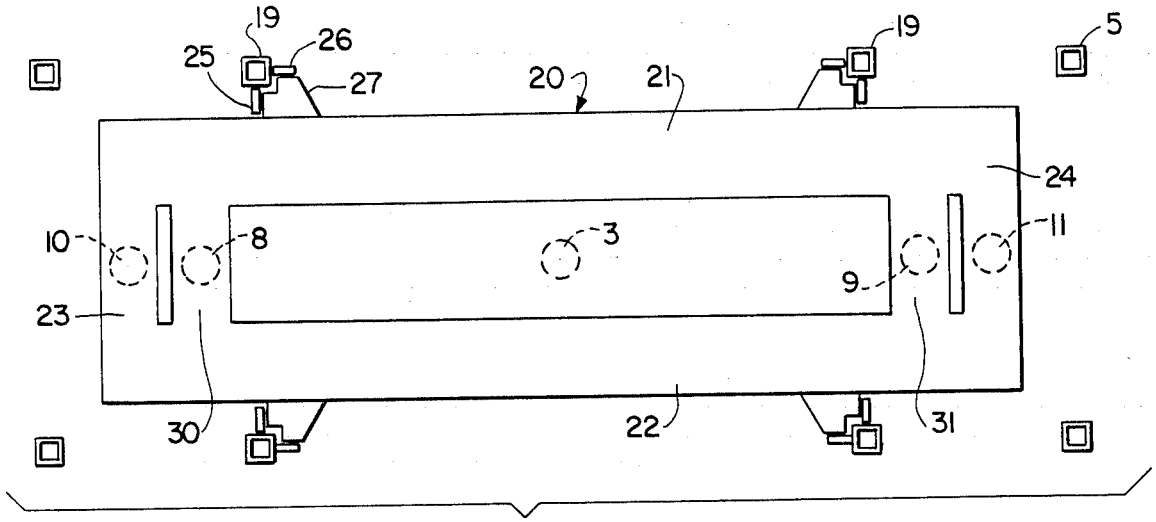
FIG. 3 is a semi-diagrammatic transverse cross-sectional view, enlarged with respect to FIG. 1 and taken generally on line 3—3, FIG. 1.

As seen in FIG. 3, the linear actuators lie in a common vertical plane which includes the well axis, one actuator of each pair being located on one side of the drilling opening and the other actuator of each pair being located on the opposite side of the well axis. Actuators 10 and 11 are spaced apart by a greater distance than are actuators 8 and 9, so that actuator 8 is disposed between actuator 10 and drilling opening 3 while actuator 9 is disposed between actuator 11 and the drilling opening. In the embodiments shown in FIGS. 1–13, the linear actuators are disposed with the rod members down and the cylinders up, and the free end of the rod members are secured to floor 2, as by heavy clevises 15. The cylinders of the actuators are free to move upwardly and downwardly relative to the combination of the substructure and tower and are restrained against lateral movement relative to the tower by low-friction means coacting between the cylinder and the adjacent leg of the tower. Thus, as seen in FIG. 8, each cylinder can be provided with two guide rollers 17 carried by a supporting frame 18 secured rigidly to the cylinder and project outwardly therefrom. Four vertical guide flanges 16 are fixed to the respective tower legs 5. Rollers 17 are located near the bottom end of cylinder 12 on each linear actuator and, with the top end of the cylinder fastened to the crown block, lateral restraint about both horizontal axes is provided for the full stroke of the linear actuator.

The travelling crown block employed, is indicated generally at 20, FIG. 3, and is of rectangular top plan form, including longer side beams 21, 22 and shorter side beams 23, 24. Roller mounts 27 each carry guide rollers 25 and 26, rollers 25 being disposed to engage one side of the respective one of two vertical guide columns 19 while rollers 26 are disposed to engage the side of guide column 19 which faces toward the central vertical axis of the crown block. Guide columns 19 form an integral part of the tower leg 5 and extend vertically for the full length of the tower so that the crown block is always restrained laterally to maintain the vertical axis of the crown block essentially coincident with the well axis.

Figure 7:
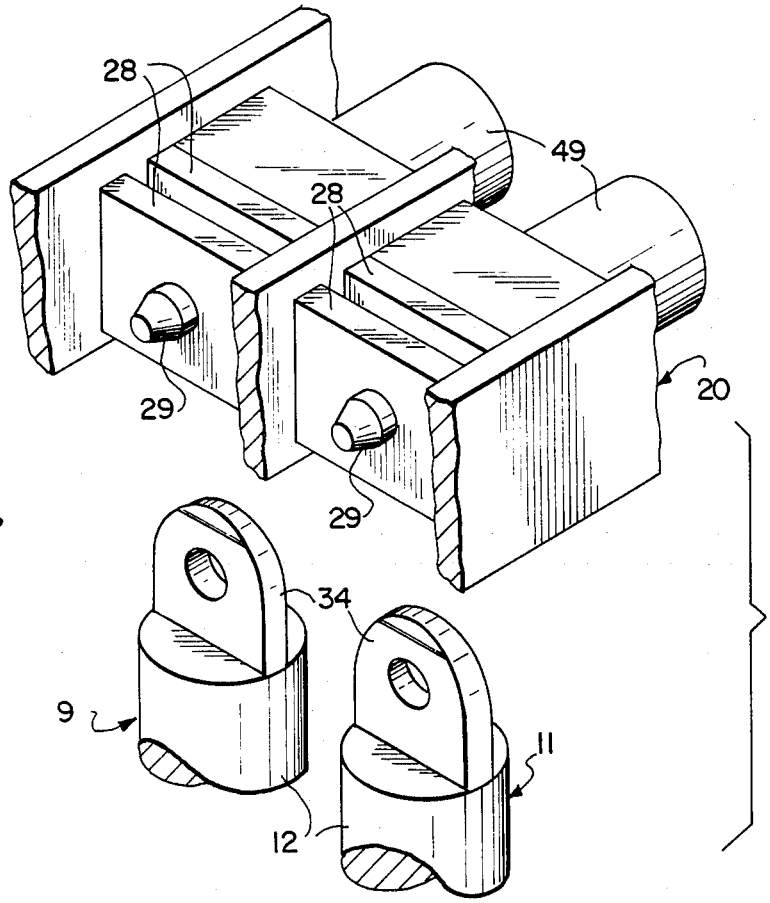
FIG. 7 is an exploded perspective view showing one form of releasable means for securing the cylinders of the linear actuators to the crown block of the derrick.
Figure 8:
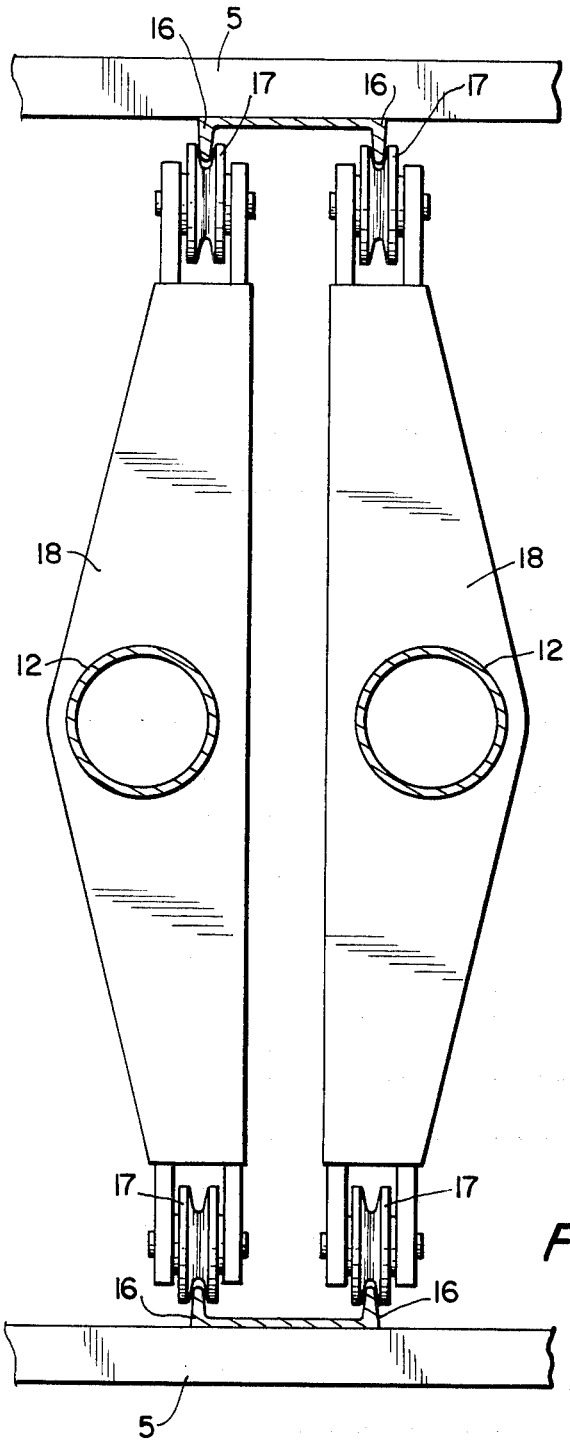
FIG. 8 is a fragmentary transverse cross-sectional view illustrating one manner in which the cylinders of the linear actuators are guided during their movement relative to the tower of the derrick.
Figure 9A:
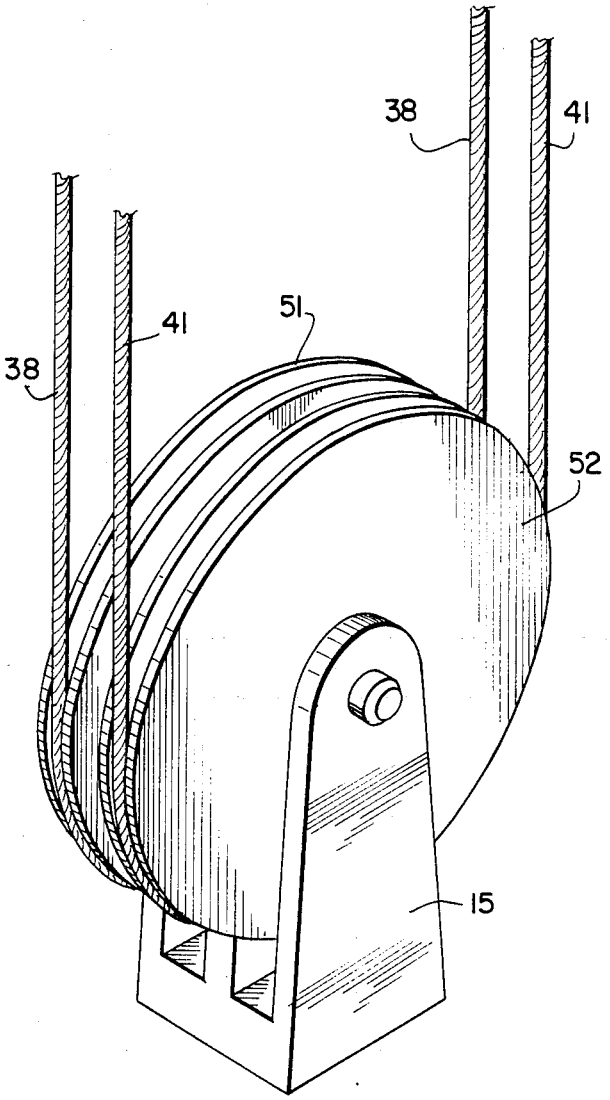
FIG. 9A is a perspective view of another form of cable tension equalizing means.
Figure 8A:
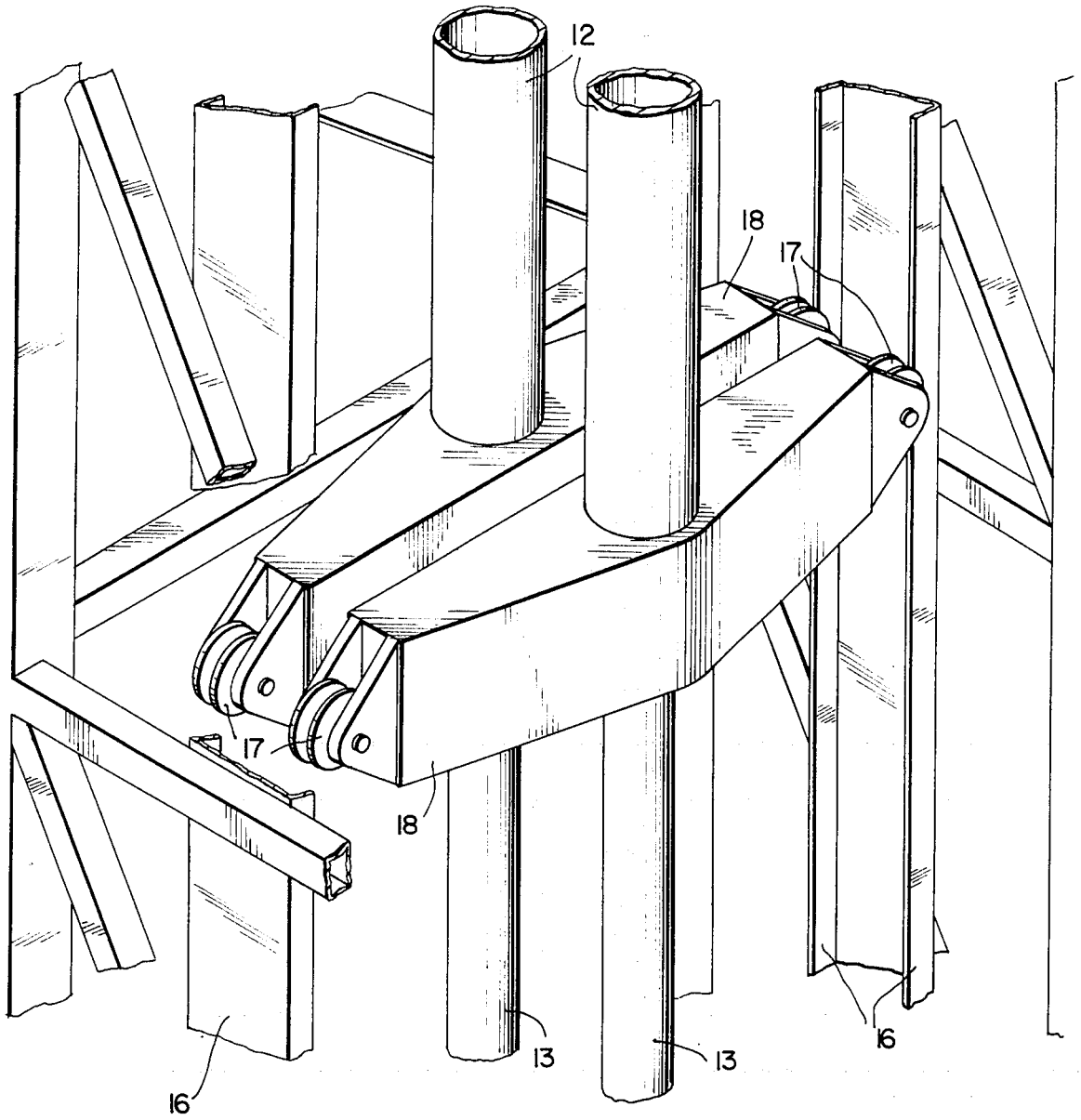
FIG. 8A is a perspective view of the structure seen in FIG. 8.
Figure 9:
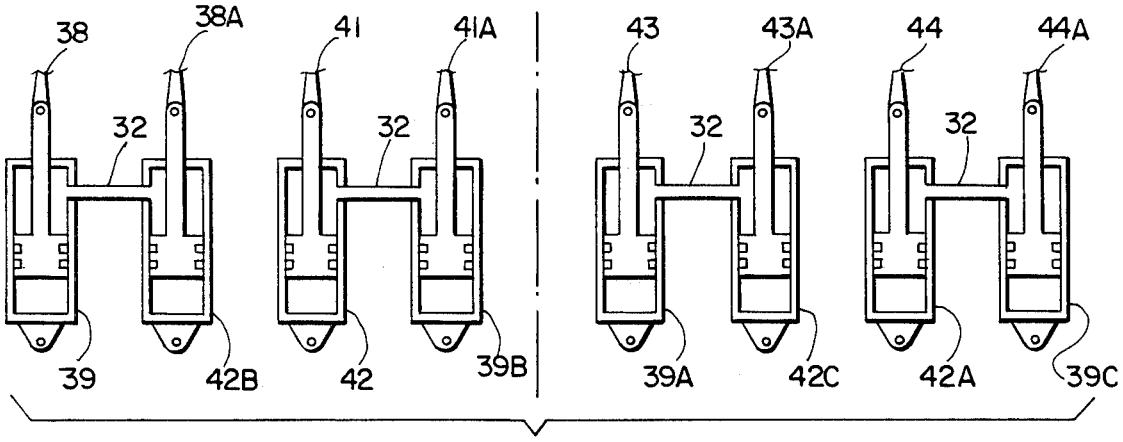
FIG. 9 is a schematic diagram illustrating one form of cable tension equalizing means useful according to the invention.

At its midpoint, each side beam 23, 24, is provided with two crown block support clevis 28, FIG. 7, by which the upper ends of cylinders 12 of linear actuator 8–11 can be secured releasably and positively to the crown block through the operation of a linear actuator 49. For each actuator 49, cylinder pin 29 is a continuation of the piston rod of the actuator and is engaged by extending the actuator and, in similar fashion, is withdrawn by retracting the actuator. Spaced inwardly from side beams 23, 24 are two cross beams 30 and 31 and each cross beam is also equipped with a structural support in the fashion shown in FIG. 7. Since the cylinder members of actuators 8–11 are laterally restrained, as by the guide roller means shown in FIG. 8, and the crown block is also laterally restrained, as by rollers 25 and 26, it will be apparent that any or all of the cylinders of actuators 8–11 can be secured positively to the crown block by inserting the cylinder rod eye 34 into the crown block support clevis 28 and engaging cylinder pin 29 in eye 34, and that any or all of the linear actuator cylinders can be disconnected from the crown block simply by retracting the respective actuator 49. Simple brackets are provided to retain each disengaged linear actuator in place in the tower during operation of the remainer of the rig.

Reeving Wheels

Figure 4:
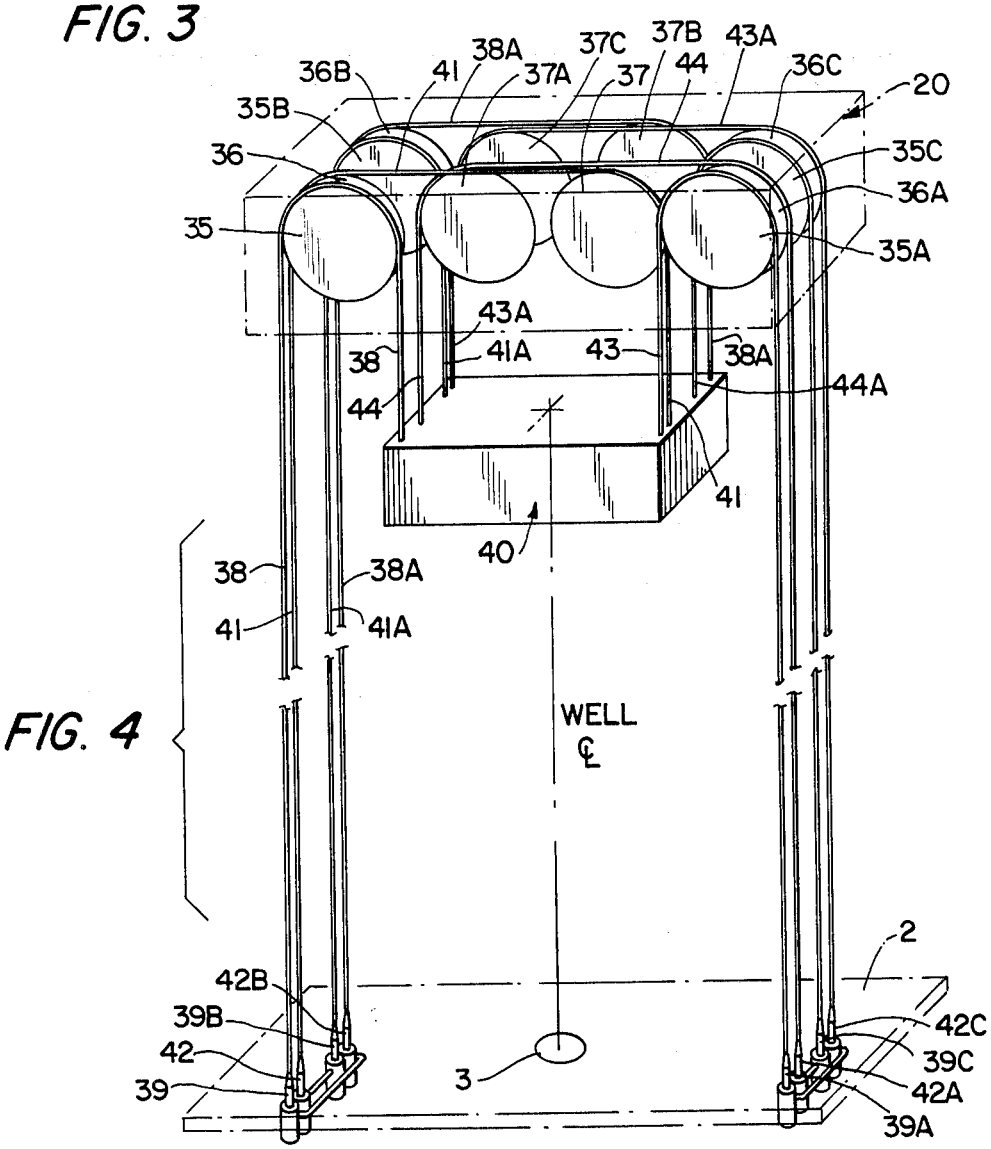
FIG. 4 is a diagram of reeving employed in the derrick of FIG. 1.

Considering FIG. 4, it will be seen that the crown block carries four sets of reeving wheels, each set containing three wheels. The first set comprises wheels 35, 36B and 37B. The second set has wheels 36, 35B and 37. The third set includes wheels 35A, 36C and 37C. The fourth set has wheels 36A, 35C and 37A.

Wheels 35 and 36B of the first set of wheels, and 36 and 35B of the second set of wheels, have centers located on a line parallel to the shorter sides of the crown block, said centers being spaced essentially equidistant from, and each on a different side of, the vertical plane containing the linear actuators 8–11. The centers of wheels 36 and 35B are disposed between wheels 35 and 36B and in similar fashion are each spaced equidistant from and on opposite sides of said vertical plane and also equidistant from the centers of wheels 35 and 36B respectively. Wheels 35A and 36C of the third set of wheels, and 36A and 35C of the fourth set of wheels, have centers located on a horizontal line parallel to the shorter sides of the crown block, that line being spaced on the opposite side of the crown block essentially an equal distance from the vertical axis of the crown block as is the horizontal line extending through the centers of wheels 35, 36, 35B and 36B.

Wheels 37B of the first set of wheels and wheel 37 of the second set of wheels have centers located on a common line parallel to the shorter side of the crown block, on the opposite side of the crown block from wheels 35, 36, 35B and 36B, are disposed between the common line extending through the centers of wheels 35, 36, 35B and 36B and the common line extending through the centers of wheels 35A, 36A, 35C and 36C. In similar fashion the centers of the wheels 37C of the third set of wheels and 37A of the fourth set of wheels are located on a common horizontal line parallel to the shorter side of the crown block, said line spaced from the center line of the crown block by the same distance on the opposite side of the crown block as is the common line extending through the centers of wheels 37 and 37B.

Cable Means

For each set of reeving wheels two cables are employed. The first cable 38 extends over only reeving wheel 35, one portion of the cable extending downwardly in uninterrupted fashion from the reeving wheel to be secured to floor 2 via an expansible chamber device 39, in this embodiment, the other end of the cable extending downwardly from wheel 35 directly to the travelling beam 40 and being rigidly secured to that side of the travelling beam. Second cable 38A extends over both reeving wheels 36B and 37B, one portion of the cable extending downwardly directly from wheel 36B in uninterrupted fashion to be secured to floor 2 via an expansible chamber device 42B, the other end of the cable extending downwardly from wheel 37B directly to the travelling beam and being secured thereto, the ends of cables 38 and 38A being secured to the travelling beam at respective locations on a straight line extending through the vertical axis of the travelling beam, said vertical axis being coincident with the well axis, the cable locations being spaced by equal distances from the vertical axis of the travelling beam. Expansible chamber device 39 is connected to expansible chamber device 42B through an interconnect 32, equalizing the pressures between the two and, the expansible chamber devices having equal piston diameters, equalizing the tension in cables 38 and 38A. In similar fashion third and fourth cables 41 and 41A are reeved over the second set of wheels 36, 35B and 37 with the ends secured to the travelling beam at locations on a straight line extending through the vertical axis of the travelling beam and each spaced an equal distance therefrom, the locations of the ends of cables 41 and 41A each also being on lines which are parallel to the shorter sides of the travelling beam and extend through the positions where cables 38A and 38 are secured. Expansible chamber devices 42, 39A and 42A are individually connected to expansible chamber devices 39B, 42C and 39C respectively through interconnects 32 to provide pressure equalization and cable tension equalization.

Considering that the reeving of cables just described relates to one half of the cables and wheels on the rig, in similar fashion for the other half of the rig, cables 43 and 43A are reeved over wheels 35A, 36C and 37C of the third set of wheels; and cables 44 and 44A are reeved over the fourth set of wheels 36A, 35C and 37A. In similar fashion expansible chamber devices 39A and 42A are connected to expansible devices 39C and 42 respectively through interconnects 32.

Figure 4A:
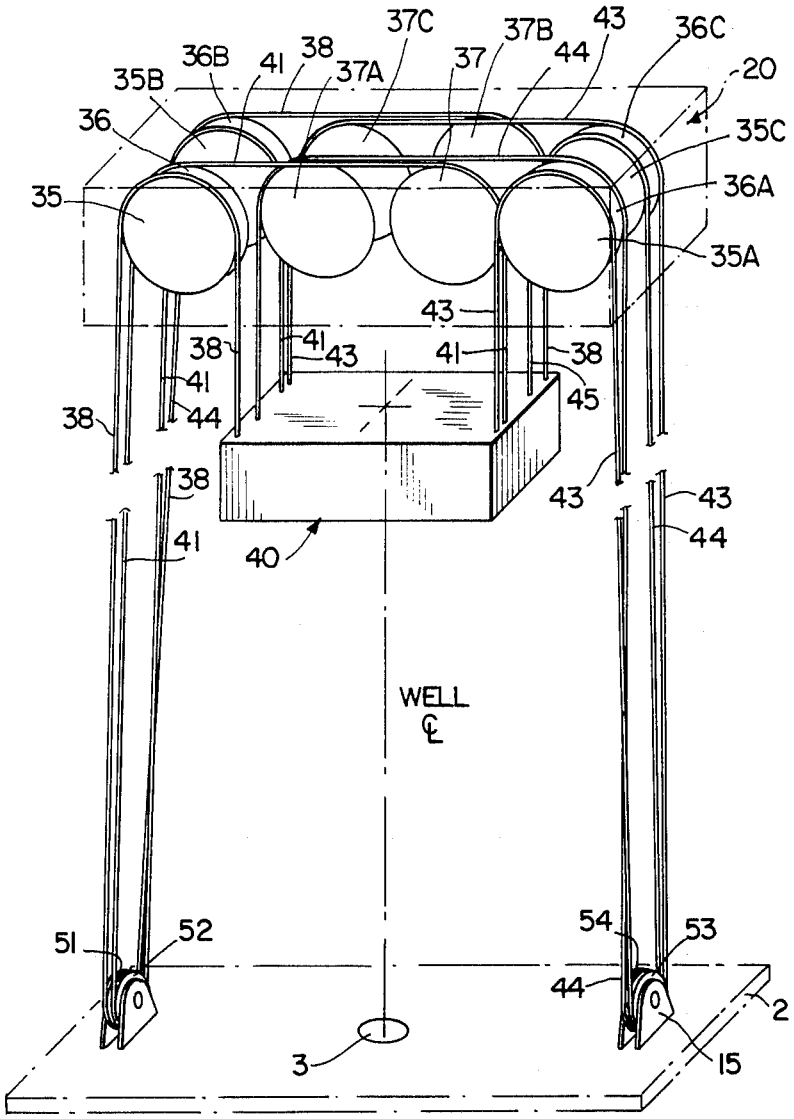
FIG. 4A is a diagram of another embodiment of reeving useful in the derrick of FIG. 1.
Figure 13:
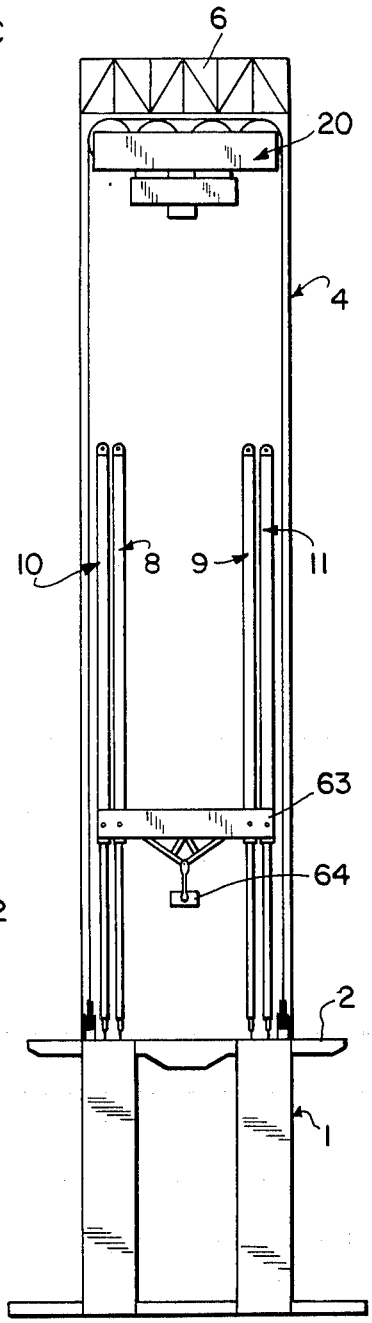
FIG. 13 is a diagrammatic view showing how the derrick of FIG. 1 is operated with a casing beam secured directly to the cylinders of the linear actuators.

In the reeving embodiment of FIG. 4A, expansible chamber devices 39 and 42B and interconnect 32 are replaced by idler wheel 51, elements 42, 39B and 32 are replaced by idler wheel 52, elements 39A, 42C and 32 are replaced by idler wheel 53, and elements 42A, 39C and 32 are replaced by idler wheel 54. The first and second cables of the first set are joined to form one continuous cable 38, the first and second cables of the second set are joined to form one continuous cable 41, the first and second cables of the third set are joined to form one continuous cable 43 and, similarly, the first and second cables of the fourth set are joined to form one continuous cable 44. Each of the continuous cables are reeved under the respective idler wheels, the idler wheels being secured to rig floor 2 by heavy clevises 15. The idler wheels provide an equalizing rotation to reduce cable tensions on each side of each wheel.

Travelling Beam

Figure 5:
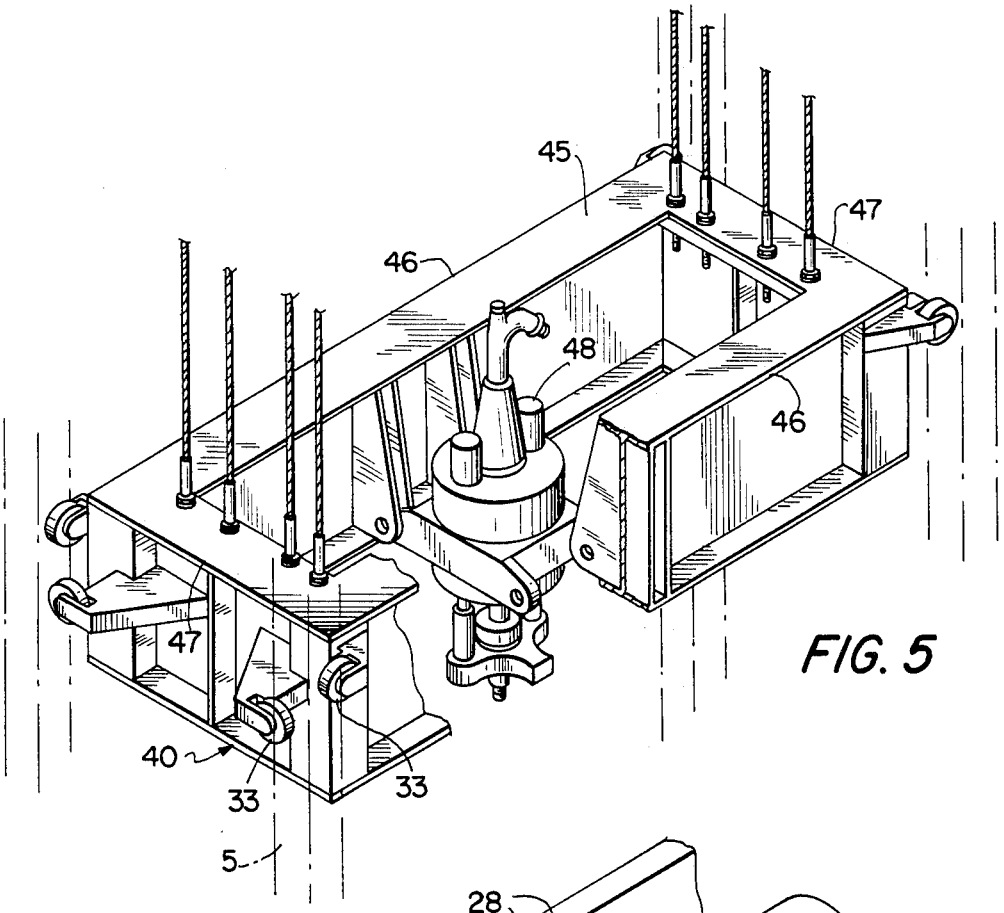
FIG. 5 is a perspective view, with parts broken away for clarity of illustration, of the travelling beam of the derrick of FIG. 1.

As shown in FIG. 5, travelling beam 40 comprises a rectangular frame 45 having long side beams 46 and short side beams 47, a power swivel 48 being mounted on the long side beams so as to be aligned with the veritcal central axis of the travelling beam and thus with the well axis in the manner shown. The eight cable ends from the crown beam reeving are secured to the short side beams 47, as shown. Restraining rollers 33 are mounted on the frame 45 in the same manner hereinbefore described with reference to guide rollers 25 and 26 of the crown beam, so that engagement between the guide rollers and vertical members of the tower legs will constantly restrain the travelling beam against lateral movement relative to the tower.

System for Selective Control of Linear Actuators

Figure 10:
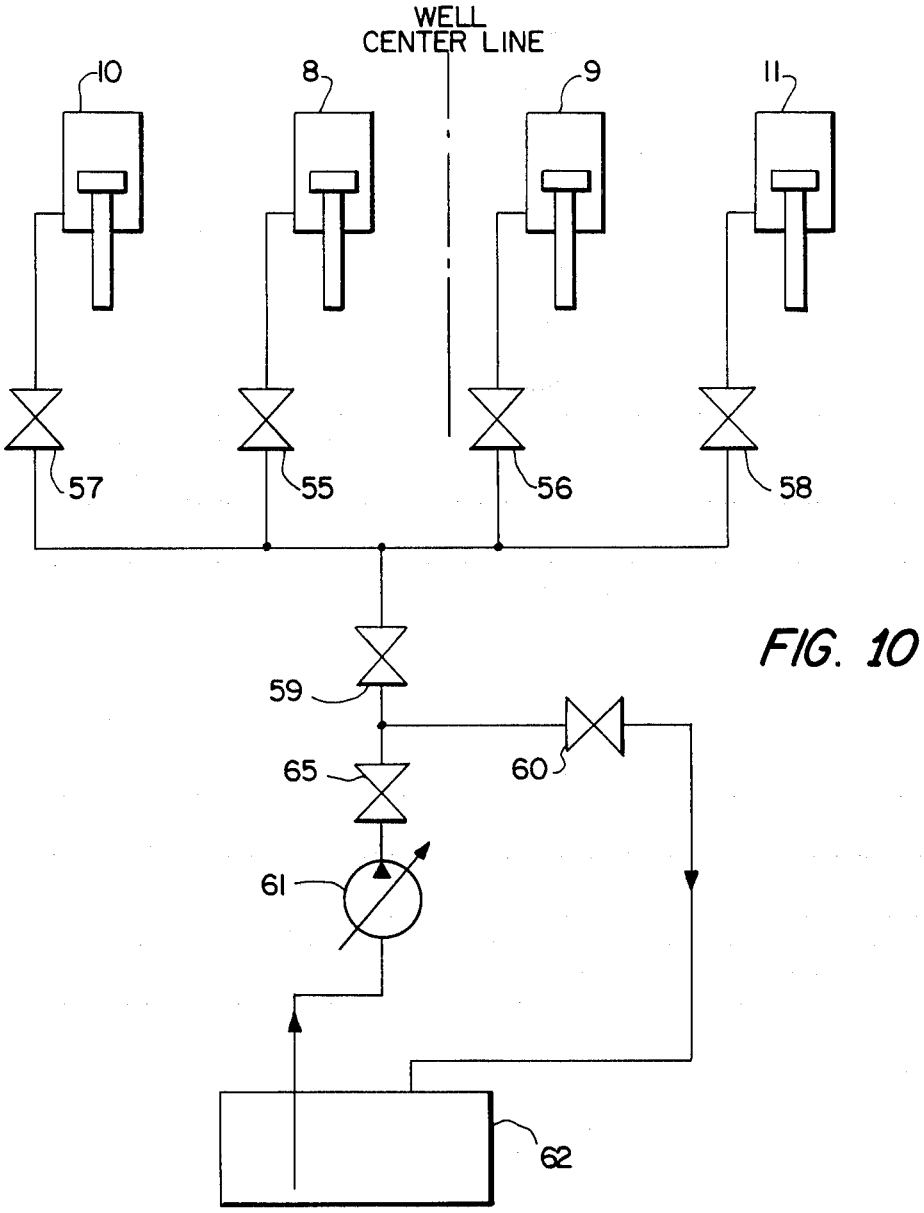
FIG. 10 is a schematic diagram of one form of the hydraulic system for operating the linear actuators of the derrick of FIG. 1.
Figure 11:
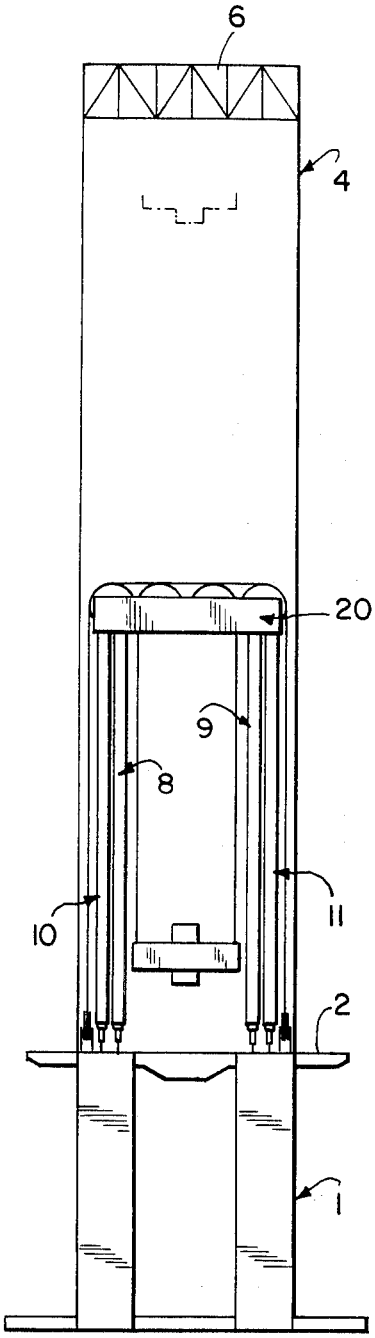
FIGS. 11–11B are diagrammatic views, all taken generally on line 11—11, FIG. 2, showing sequential positions of components of the derrick during hoisting according to one mode of operation.
Figure 11A:
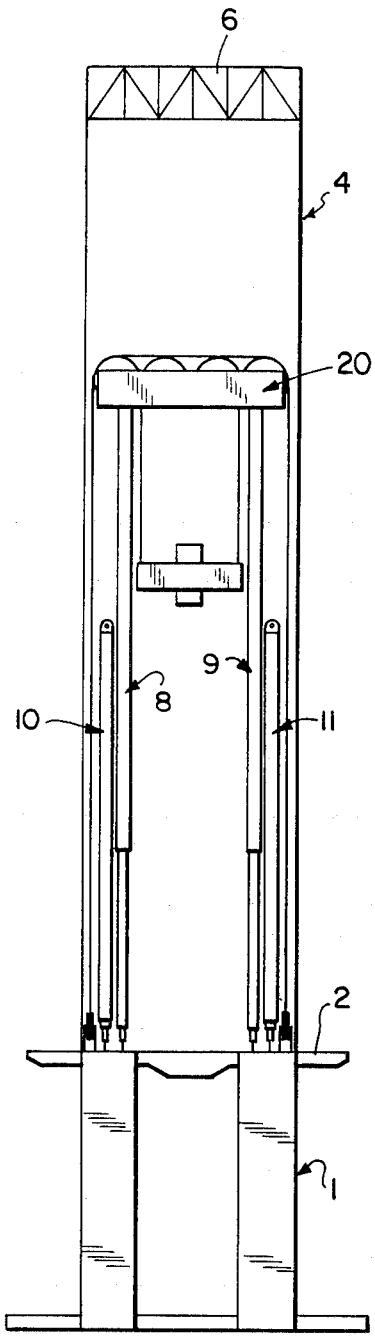
Figure 11B:
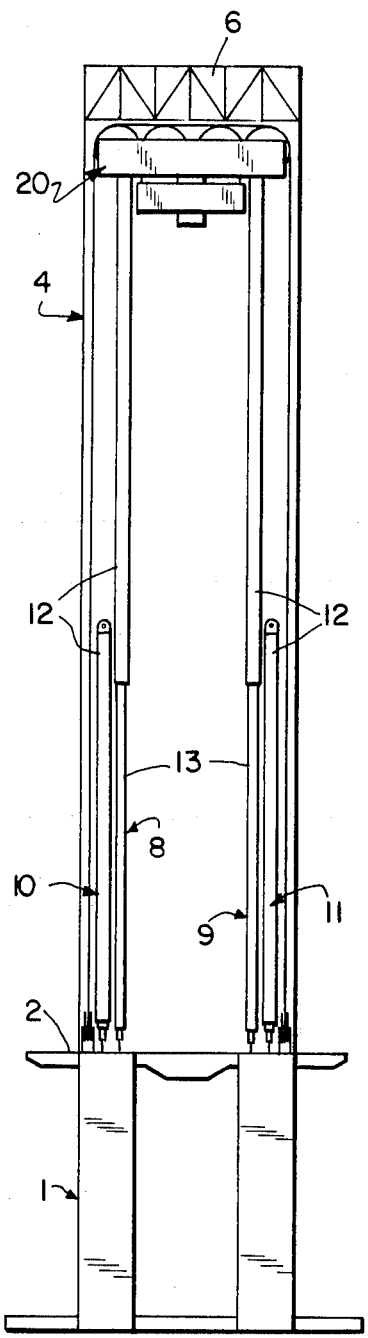
Figure 12:
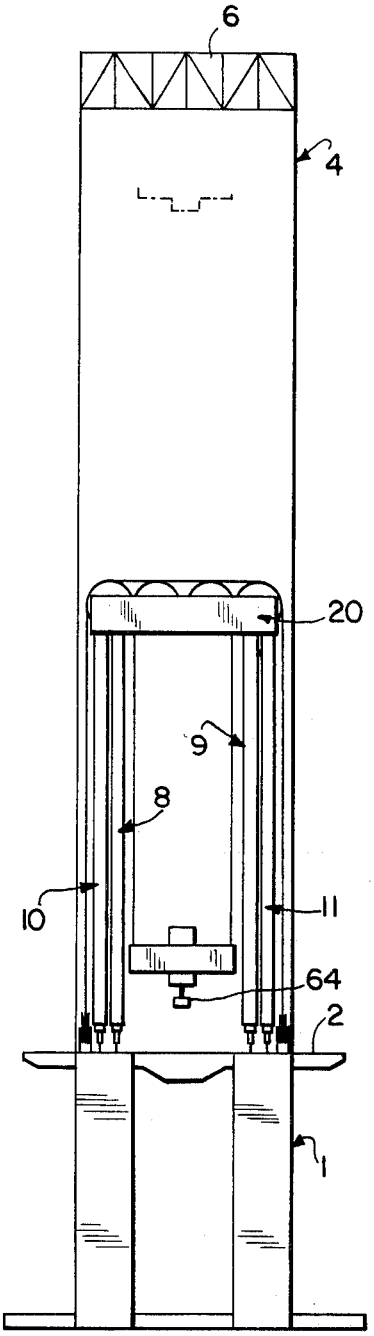
FIGS. 12–12B are diagrammatic views, similar to FIGS. 11–11B, respectively, illustrating sequential positions of components during hoisting according to another mode of operation and showing the travelling beam equipped with a casing elevator.
Figure 12A:
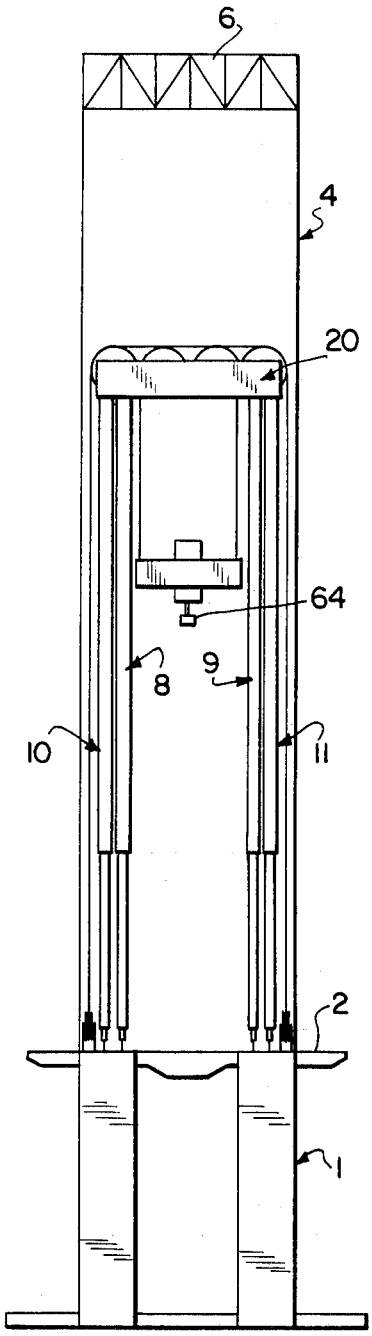
Figure 12B:
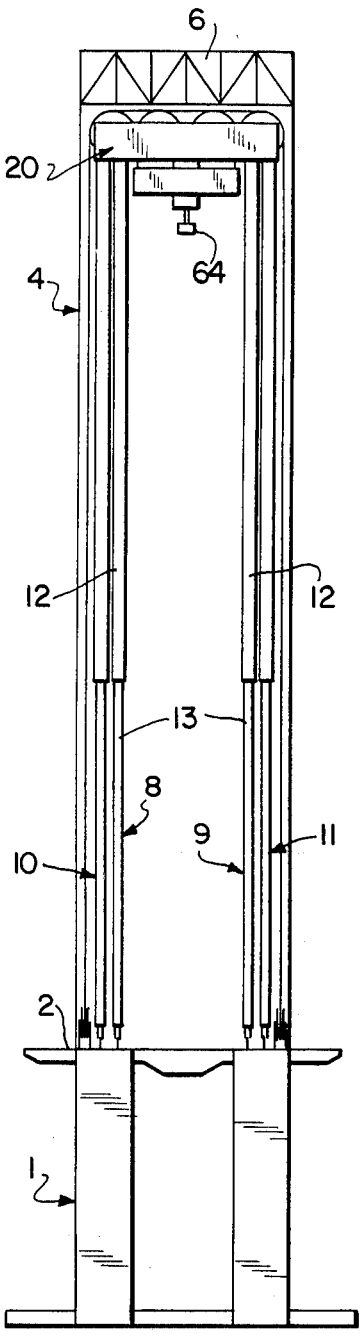

The hydraulic system, FIG. 10, comprising hydraulic fluid reservoir 62, hydraulic pump and motor 61 and control valves 59, 60 and 65 is used to power the linear actuators 8–11 under the control of valves 55–58. With valves 65 and 59 open and valve 60 closed, hydraulic fluid under pressure from pump 61 can be directed to the first pair of linear actuators 8 and 9 by opening valves 55 and 56. Similarly, opening of only valves 57 and 58 will direct the pressurized fluid to the outer pair of linear actuators 10 and 11. In like fashion all four linear actuators can be operated by opening all four valves 55, 56, 57 and 58.

The balancing features of the cable and wheel reeving system in operating the crown block and travelling beam while hoisting a hook load at the well axis permit hoisting with unbalanced linear actuators, pairing 57 and 56 and 55 with 58, as well as the use of three actuators for hoisting, 57, 56 and 58; 55, 56 and 58; 57, 55 and 56; and finally 57, 55, and 58 by opening the associated valves for those linear actuators.

Variations in Load-Carrying Capacity

As discussed above, for light loads, one pair of actuators 8–11 are connected to the crown block 20, which is free to move longitudinally in the well derrick, and operated as desired. For heavier loads, all four actuators 8–11 are attached to crown block 20 and operated as desired. For even heavier loads, crown block 20 is fixedly attached to the derrick structure and a casing beam is attached directly to the actuators 8–11 (either one pair or both pairs depending on the load).

Embodiment with Linear Actuator Rods in Tension

The versatility of the invention can be further applied, through another embodiment, to the design of smaller rigs with lower hoisting loads while maintaining the actuator stroke of 55 feet and the travelling beam stroke of 110 feet. With these rigs, the smaller diameters of the actuators and their elongated rod members present a problem of possible buckling of the rod when the rod is secured to the substructure and the hoisting loads are transmitted through these smaller rods as compression forces.

Figure 14:
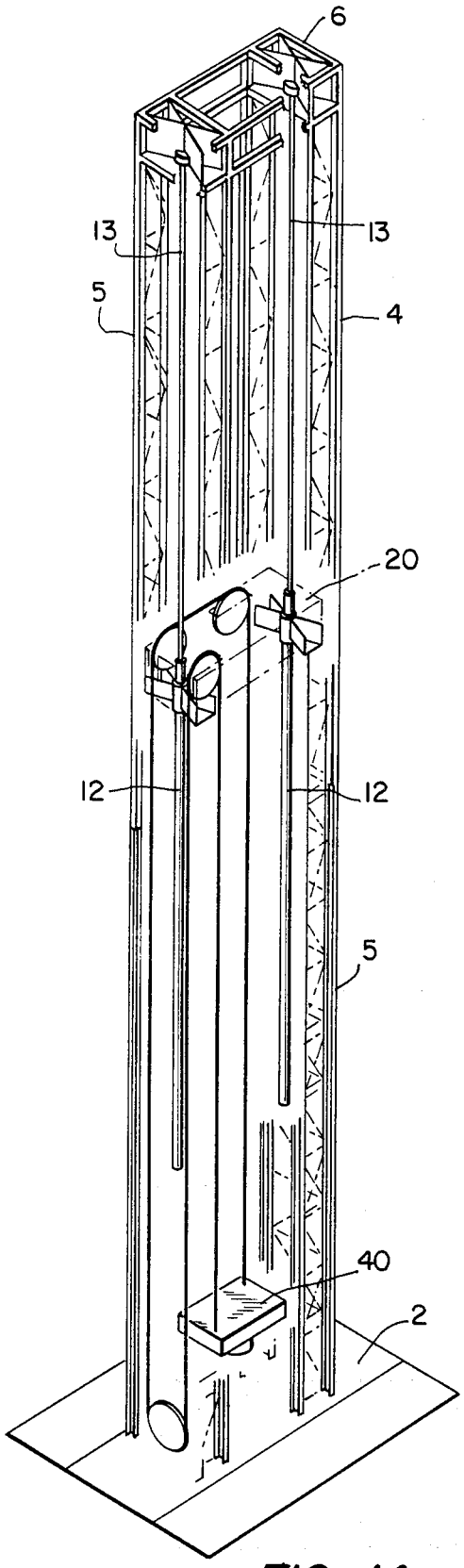
FIGS. 14 and 14A are perspective views illustrating a well derrick according to another embodiment, in which the rods of the linear actuators support the hook load in tension.
Figure 14A:
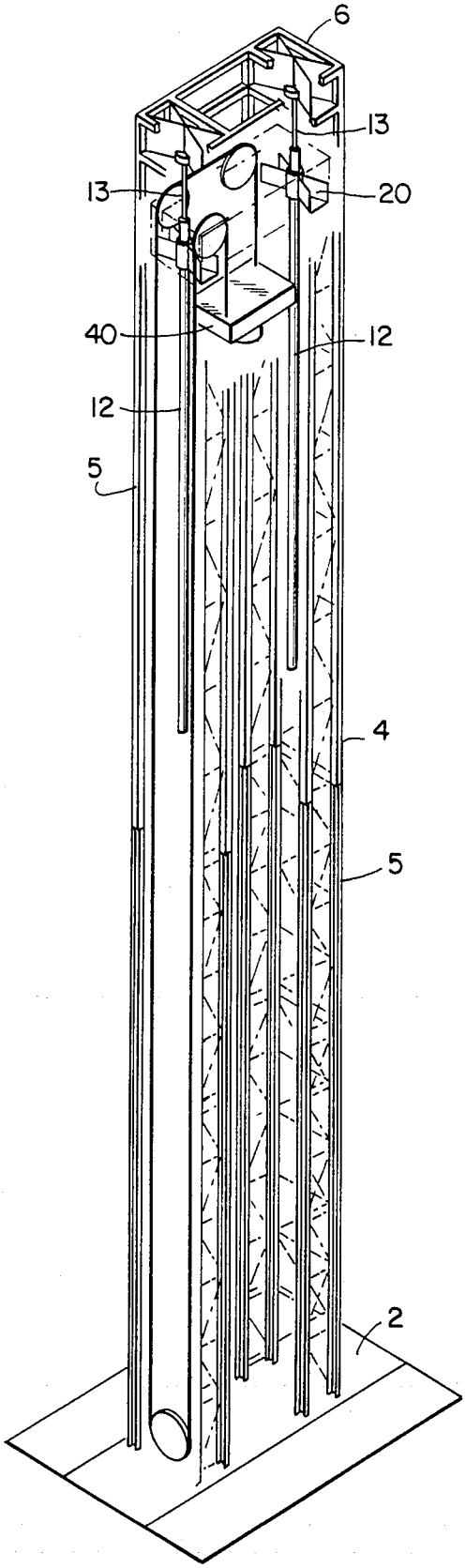

As seen in FIGS. 14–14A the linear actuators are disposed with the rod members 13 up and the cylinders 12 down, and the free ends of the rod members secured to the horizontal upper end structure 6. The top of the cylinders are secured to the crown block so that the crown block and cylinders have the full 55 feet of travel. With the travelling crown block, reeving wheels, cable means, travelling beam, and hydraulic control system all functioning the same as in the larger embodiments, the operation, balancing, and dampening of the hoist system remains the same. With the long slender rods suspended from the horizontal upper end structure, the loads on the rods are in tension, thus eliminating all buckling tendencies.

What is claimed is:

1. In a well derrick, the combination of a substructure including a floor having a drilling opening to be aligned with a well axis;

a tower supported by the substructure and projecting upwardly therefrom;

a travelling crown block having a vertical axis;

guide means coacting between the crown block and the tower to restrain the crown block laterally to maintain the vertical axis of the crown block aligned above the drilling opening of the floor while allowing the crown block to travel upwardly and downwardly relative to the tower;

at least one pair of hydraulically operated linear actuators extending upwardly above the floor and each including an elongated hollow cylinder, an elongated rod member telescopically arranged within the cylinder, and means coacting between the cylinder and the rod member in piston fashion, the rod members having free end portions projecting from the respective cylinders, the cylinders having closed ends opposite the rod members, the linear actuators of each pair being located each on a different side of the drilling opening;

releasable means for securing one of (a) the free ends of the rod members and (b) the closed ends of the cylinders to the crown block, the other of (a) the free ends of the rod members and (b) the closed ends of the cylinders being secured to one of the substructure and an upper end portion of the tower to fix said other of the cylinders and the rod members against longitudinal movement relative to the combination of the substructure and the tower, whereby the crown block can be driven upwardly and downwardly by operation of the linear actuators;

reeving means mounted on the crown block and having four sets of reeving wheels, each set of reeving wheels comprising first and second reeving wheels having centers located on a common horizontal line parallel to one side of the crown block and located on one side of the vertical axis of the crown block, and a third reeving wheel located on the opposite side of the vertical axis of the crown block:

a travelling beam; and cable means comprising for each set of reeving wheels a first cable having one end connected to the substructure and extending upwardly, over the first reeving wheel and thence downwardly to the travelling beam, the other end of the first cable being secured to the travelling beam on the side thereof adjacent the first reeving wheel, and a second cable having one end connected to the substructure and extending upwardly, over both the second and third reeving wheels and thence downwardly to the travelling beam, the other end of the second cable being secured to the travelling beam on the side thereof diagonally opposite the location of the first cable, said one ends of the cables for the first and second sets of wheels being connected to the substructure on one side of the well axis, and said one ends of the cables for the third and fourth sets of wheels being connected to the substructure on the opposite side of the well axis;

the first and second wheels of the first set of reeving wheels have centers located on a first horizontal line perpendicular to a vertical plane containing the longitudinal axes of the linear actuators and the well axis, said centers being located on a different side of and spaced equally from said vertical plane;

the first and second wheels of the second set of reeving wheels having centers located on said first horizontal line, spaced equally from said vertical plane and each disposed between that plane and a different one of the first set of reeving wheels;

the centers of the first and second wheels of the third set of reeving wheels being located on a second horizontal line perpendicular to said vertical plane and located each on a different side of and spaced equally from said vertical plane, said second horizontal line being on the other side of said well axis from said first horizontal line; and the centers of the first and second wheels of the fourth set of reeving wheels being located on said second horizontal line each on a different side of and spaced equally from said vertical plane and each disposed between that plane and a different one of the first and second wheels of the third set of reeving wheels.

2. The combination defined by claim 1, wherein the cylinders have upper and lower ends;

the free ends of the rod members are secured to the substructure; and the upper end of the cylinders are securable to the crown block by releasable means.

3. The combination defined by claim 2, wherein said one ends of the first and second cables are secured to said floor.

4. The combination defined by claim 2, further comprising expansible chamber devices, wherein one end of each of said cables is secured to the substructure via one of said expansible chamber hydraulic devices; and means for interconnecting two of said expansible chamber devices;

the two expansible chamber devices for each set of cables are interconnected to equalize tensions of the cables.

5. The combination defined by claim 4, wherein said well derrick is designed such that any unbalanced upward forces applied by the linear actuators combine with the cable tension forces, and the forces at the reeving wheel centers transmitted by the cable tension forces, to produce a resultant upwardly acting force directly opposing the load suspended from the travelling beam, said resultant force and the downwardly acting force of the suspended load being coincident with the well axis.

6. The combination defined by claim 1, wherein the linear actuators are disposed with the free end portions of the rod members projecting upwardly; and the free end portions of the rod members are secured to an upper end portion of the tower.

7. The combination defined by claim 6, wherein.

8. The combination defined by claim 1, wherein there are two pairs of said linear actuators and the longitudinal axes of the four linear actuators all lie in a common plane which includes the vertical axis of the crown block.

9. The combination defined by claim 8 and further comprising controllable supply means for supplying pressure fluid selectively to the respective linear actuators, whereby any selected two of the linear actuators can be energized simultaneously to the exclusion of the other linear actuators when the derrick is to handle a smaller load, and all four of the linear actuators can be energized simultaneously when the derrick is to handle a larger load.

10. The combination defined by claim 1, wherein first and second wheels of the first and second sets of reeving wheels are located on a first side of the crown block and the third wheel of the first and second sets is located on the opposite side of the crown block; and first and second wheels of the third and fourth sets of reeving wheels are located on said opposite side of the crown block and the third wheel of each of the third and fourth sets of reeving wheels is located on said first side of the crown block.

11. The combination defined by claim 10, wherein the crown block is of elongated rectangular form and has two shorter sides and two longer sides;

said first horizontal line being parallel to and adjacent one shorter side of the crown block, said second horizontal line being parallel to and adjacent the other shorter side of the crown block.

12. The combination defined by claim 1, wherein the centers of the third wheel of the first and second sets of reeving wheels are located on a third horizontal line perpendicular to the vertical plane and located on the side of the well axis opposite the first and second wheels of the first and second sets of reeving wheels, respectively; and the centers of the third wheel of the third and fourth sets of reeving wheels are located on a fourth horizontal line perpendicular to the vertical plane and located on the side of the well axis opposite the first and second wheels of the third and fourth sets of reeving wheels, respectively.

13. The combination defined by claim 12, wherein the third wheel of the first set of wheels is located on the same side of said vertical plane as is the second wheel of the first set of wheels and is spaced from said plane by substantially the same distance as is the second wheel; and in similar fashion, the third wheel of each of the second, third and fourth sets of wheels is located on the same side of said vertical plane as is the second wheel of the second, third and fourth sets of wheels, respectively, and is spaced from said plane by substantially the same distance as is the second wheel.

14. The combination defined by claim 13, wherein said well derrick is designed such that any unbalanced upward forces applied by the linear actuators combine with the cable tension forces, and the forces at the reeving wheel centers transmitted by the cable tension forces, to produce a resultant upwardly acting force directly opposing the load suspended from the travelling beam, said resultant force and the downwardly acting force of the suspended load being coincident with the well axis.

15. The combination defined by claim 1, wherein the reeving means further comprises, for each set of reeving wheels, an idler wheel mounted on the substructure; and for each of the sets of reeving wheels, said one end of the first cable of the cable means and said one end of the second cable of the cable means are joined so that the first and second cables constitute a single cable, and said single cable extends under the respective one of the idler wheels.

16. The combination defined by claim 15, wherein said well derrick is designed such that any unbalanced upward forces applied by the linear actuators combine with the cable tension forces, and the forces at the reeving wheel centers transmited by the cable tension forces, to produce a resultant upwardly acting force directly opposing the load suspended from the travelling beam, said resultant force and the downwardly acting force of the susupended load being conincident with the well axis.

17. The combination defined by claim 1, wherein said releasable means is remotely operable.

18. The combination defined by claim 1, wherein said well derrick is designed such that any unbalanced upward forces applied by the linear actuators combine with the cable tension forces, and the forces at the reeving wheel centers transmitted by the cable tension forces, to produce a resultant upwardly acting force directly opposing the load suspended from the travelling beam, said resultant force and the downwardly acting force of the suspended load being coincident with the well axis.

19. In a well derrick, the combination of a substructure including a floor having a drilling opening to be aligned with a well axis;

a tower supported by the substructure and projecting upwardly therefrom;

a travelling crown block having a vertical axis; guide means coacting between the crown block and the tower to restrain the crown block laterally to maintain the vertical axis of the crown block aligned above the drilling opening of the floor while allowing the crown block to travel upwardly and downwardly relative to the tower;

at least one pair of hydraulically operated linear actuators extending upwardly above the floor and each including an elongated hollow cylinder, an elongated rod member telescopically arranged within the cylinder, and means coacting between the cylinder and the rod member in piston fashion, the rod members having free end portions projecting from the respective cylinders, the cylinders having closed ends opposite the rod members, the linear actuators of each pair being located each on a different side of the drilling opening;

releasable means for securing one of (a) the free ends of the rod members and (b) the closed ends of the cylinders to the crown block, the other of (a) the free ends of the rod members and (b) the closed ends of the cylinders being secured to one of the substructure and an upper end portion of the tower to fix said other of the cylinders and the rod members against longitudinal movement relative to the combination of the substructure and the tower, whereby the crown block can be driven upwardly and downwardly by operation of the linear actuators;

reeving means mounted on the crown block having a plurality of reeving wheels, a travelling beam;

cable means including a number of cables attached to the travelling beam and to the substructure, said cables engaging one or more of the reeving wheels, and expansible chamber hydraulic devices and means for interconnecting said expansible chamber hydraulic devices;

wherein said derrick is designed such that any unbalanced upward forces applied by the linear actuators combine with the cable tension forces, and the forces at the reeving wheel centers transmitted by the cable tension forces, to produce a resultant upwardly acting force directly opposing the load suspended from the travelling beam, said resultant force and the downwardly acting force of the suspended load being coincident with the well axis;

wherein one end of each of said cables is secured to the substructure via one of said expansible chamber hydraulic devices;

the expansible chamber devices for two of said cables are interconnected to equalize tensions of the two cables.

20. The combination defined by claim 19, wherein said reeving means includes four sets of reeving wheels, each said set comprising:

first and second reeving wheels having centers located on a common horizontal line parallel to one side of the crown block and located on one side of the vertical axis of the crown block, and a third reeving wheel located on the opposite side of the vertical axis of the crown block;

said cable means comprising for each set of reeving wheels a first cable having one end connected to the substructure and extending upwardly, over the first reeving wheel and thence downwardly to the travelling beam, the other end of the first cable being secured to the travelling beam on the side thereof adjacent the first reeving wheel, and a second cable having one end connected to the substructure and extending upwardly, over both the second and third reeving wheels and thence downwardly to the travelling beam, the other end of the second cable being secured to the travelling beam on the side thereof diagonally opposite the location of the first cable, and said one ends of the cables for the first and second sets of wheels being connected to the substructure on one side of the well axis, and said one ends of the cables for the third and fourth sets of wheels being connected to the substructure on the opposite side of the well axis.

21. The combination defined by claim 20, wherein first and second wheels of the first and second sets of reeving wheels are located on a first side of the crown block and the third wheel of the first and second sets is located on the opposite side of the crown block; and first and second wheels of the third and fourth sets of reeving wheels are located on said opposite side of the crown block and the third wheel of each of the third and fourth sets of reeving wheels is located on said first side of the crown block.

22. The combination defined by claim 21, wherein the crown block is of elongated rectangular form and has two shorter side and two longer sides;

the first and second wheels of the first set of reeving wheels have centers located on a horizontal line parallel to and adjacent one shorter side of the crown block, said centers being located each on a different side of and spaced equally from a vertical plane containing the longitudinal axes of the linear actuators and the well axis;

the first and second wheels of the second set of reeving wheels having centers located on said horizontal line, spaced equally from said vertical plane and each disposed between that plane and a different one of the first set of reeving wheels;

the centers of the first and second wheels of the third set of reeving wheels being located on a second horizontal line parallel to and adjacent the other shorter side of the crown block and located each on a different side of and spaced equally from said vertical plane; and the centers of the first and second wheels of the fourth set of reeving wheels being located on said second horizontal line each on a different side of and spaced equally from said vertical plane and each disposed between that plane and a different one of the first and second wheels of the third set of reeving wheels.

23. The combination defined by claim 22, wherein the centers of the third wheel of the first and second sets of reeving wheels are located on a third horizontal line parallel to the shorter sides of the rectangle and located on the side of the well axis opposite the first and second wheels of the first and second sets of reeving wheels, respectively; and the centers of the third wheel of the third and fourth sets of reeving wheels are located on a fourth horizontal line parallel to the shorter sides of the rectangle and located on the side of the well axis opposite the first and second wheels of the third and fourth sets of reeving wheels, respectively.

24. The combination defined by claim 23, wherein the third wheel of the first set of wheels is located on the same side of said vertical plane as is the second wheel of the first set of wheels and is spaced from said plane by substantially the same distance as is the second wheel; and in similar fashion, the third wheel of each of the second, third and fourth sets of wheels is located on the same side of said vertical plane as is the second wheel of the second, third and fourth sets of wheels, respectively, and is spaced from said plane by substantially the same distance as is the second wheel.

25. The combination defined by claim 22, wherein the centers of the third wheel of the first and second sets of reeving wheels are located on a third horizontal line parallel to the shorter sides of the rectangle and located on the side of the well axis opposite the first and second wheels of the first and second sets of reeving wheels, respectively; and the centers of the third wheel of the third and fourth sets of reeving wheels are located on a fourth horizontal line parallel to the shorter sides of the rectangle and located on the side of the well axis opposite the first and second wheels of the third and fourth sets of reeving wheels, respectively.

26. The combination defined by claim 25, wherein the third wheel of the first set of wheels is located on the same side of said vertical plane as is the second wheel of the first set of wheels and is spaced from said plane by substantially the same distance as is the second wheel; and in similar fashion, the third wheel of each of the second, third and fourth sets of wheels is located on the same side of said vertical plane as is the second wheel of the second, third and fourth sets of wheels, respectively, and is spaced from said plane by substantially the same distance as is the second wheel.

27. The combination defined by claim 19, wherein the cylinders have upper and lower ends;

the free ends of the rod members are secured to the substructure; and the upper ends of the cylinders are securable to the crown block by releasable means.

28. The combination defined by claim 19, wherein the linear actuators are disposed with the free end portions of the rod members projecting upwardly; and the free end portions of the rod members are secured to an upper end portion of the tower.

29. The combination defined by claim 19, wherein there are two pairs of said linear actuators and the longitudinal axes of the four linear actuators all lie in a common plane which includes the vertical axis of the crown block.

30. The combination defined by claim 29 and further comprising controllable supply means for supplying pressure fluid selectively to the respective linear actuators, whereby any selected two of the linear actuators can be energized simultaneously to the exclusion of the other linear actuators when the derrick is to handle a smaller load, and all four of the linear actuators can be energized simultaneously when the derrick is to handle a larger load.

31. The combination defined by claim 19, further comprising idler wheels rotatably attached to said substructure, said cables being received by said idler wheels and having both ends attached to said travelling beam.

32. The combination defined by claim 31 wherein said reeving means includes four sets of reeving wheels, each said set comprising:

first and second reeving wheels having centers located on a common horizonal line parallel to one side of the crown block and located on one side of the vertical axis of the crown block, and a third reeving wheel located on the opposite side of the vertical axis of the crown block;

said cable means comprising for each set of reeving wheels a first cable having one end connected to the travelling beam and extending upwardly, over the first reeving wheel, thence downwardly around one of said idler wheels, back up around the second and third reeving wheels and down to the travelling beam, the other end of the first cable being secured to the travelling beam, the ends of each cable being attached to the travelling beam on diagonally opposite sides of the travelling beam.

33. The combination defined by claim 32, wherein the free ends of the rod members are secured to the substructure; and the upper ends of the cylinders are securable to the crown block by releasable means.

34. The combination defined by claim 32, wherein first and second wheels of the first and second sets of reeving wheels are located on a first side of the crown block and the third wheel of the first and second sets is located on the opposite side of the crown block; and first and second wheels of the third and fourth sets of reeving wheels are located on said opposite side of the crown block and the third wheel of each of the third and fourth sets of reeving wheels is located on said first side of the crown block.

35. The combination defined by claim 34, wherein the crown block is of elongated rectangular form and has two shorter sides and two longer sides;

the first and second wheels of the first set of reeving wheels have centers located on a horizontal line parallel to and adjacent one shorter side of the crown block, said centers being located each on a different side of and spaced equally from a vertical plane containing the longitudinal axes of the linear actuators and the well axis;

the first and second wheels of the second set of reeving wheels having centers located on said horizontal line, spaced equally from said vertical plane and each disposed between that plane and a different one of the first set of reeving wheels;

the centers of the first and second wheels of the third set of reeving wheels being located on a second horizontal line parallel to and adjacent the other shorter side of the crown block and located each on a different side of and spaced equally from said vertical plane; and the centers of the first and second wheels of the fourth set of reeving wheels being located on said second horizontal line each on a different side of and spaced equally from said vertical plane and each disposed between that plane and a different one of the first and second wheels of the third set of reeving wheels.

36. The combination defined by claim 31, wherein the linear actuators are disposed with the free end portions of the rod members projecting upwardly; and the free end portions of the rod members are secured to an upper end portion of the tower.

37. The combination defined by claim 31, wherein there are two pairs of said linear actuators and the longitudinal axes of the four linear actuators all lie in a common plane which includes the vertical axis of the crown block.

38. The combination defined by claim 37 and further comprising controllable supply means for supplying pressure fluid selectively to the respective linear actuators, whereby any selected two of the linear actuators can be energized simultaneously to the exclusion of the other linear actuators when the derrick is to handle a smaller load, and all four of the linear actuators can be energized simultaneously when the derrick is to handle a larger load.

39. In a well derrick, the combination of a substructure including a floor having a drilling opening to be aligned with a well axis;

a tower supported by the substructure and projecting upwardly therefrom;

a travelling crown block having a vertical axis;

guide means coacting between the crown block and the tower to restrain the crown block laterally to maintain the vertical axis of the crown block aligned above the drilling opening of the floor while allowing the crown block to travel upwardly and downwardly relative to the tower;

at least one pair of hydraulically operated linear actuators extending upwardly above the floor and each including an elongated hollow cylinder, an elongated rod member telescopically arranged within the cylinder, and means coacting between the cylinder and the rod member in piston fashion, the rod members having free end portions projecting from the respective cylinders, the cylinders having closed ends opposite the rod members, the linear actuators of each pair being located each on a different side of the drilling opening;

releasable means for securing one of (a) the free ends of the rod members and (b) the closed ends of the cylinders to the crown block, the other of (a) the free ends of the rod members and (b) the closed ends of the cylinders being secured to one of the substructure and an upper end portion of the tower to fix said other of the cylinders and the rod members against longitudinal movement relative to the combination of the substructure and the tower, whereby the crown block can be driven upwardly and downwardly by operation of the linear actuators;

reeving means mounted on the crown block and having four sets of reeving wheels, each set of reeving wheels comprising first and second reeving wheels having centers located on a first horizontal line perpendicular to a vertical plane through the longitudinal axes of the linear actuators and the well axis and located on one side of the vertical axis of the crown block, and a third reeving wheel located on the opposite side of the vertical axis of the crown block:

a travelling beam;

cable means comprising for each set of reeving wheels a first cable having one end connected to the substructure and extending upwardly, over the first reeving wheel and thence downwardly to the travelling beam, the other end of the first cable being secured to the travelling beam on the side thereof adjacent the first reeving wheel, and a second cable having one end connected to the substructure and extending upwardly, over both the second and third reeving wheels and thence downwardly to the travelling beam, the other end of the second cable being secured to the travelling beam on the side thereof diagonally opposite the location of the first cable, said one ends of the cables for the first and second sets of wheels being connected to the substructure on one side of the well axis, and said one ends of the cables for the third and fourth sets of wheels being connected to the substructure on the opposite side of the well axis;

said one end of each of said cables is secured to the substructure via an expansible chamber hydraulic device; and means for interconnecting the two expansible chamber devices for each said cable means, wherein the two expansible chamber devices for each said cable means are interconnected to equalize tensions of the cables.

40. In a well derrick, the combination of a substructure including a floor having a drilling opening to be aligned with a well axis;

a tower supported by the substructure and projecting upwardly therefrom;

a travelling crown block having a vertical axis;

guide means coacting between the crown block and the tower to restrain the crown block laterally to maintain the vertical axis of the crown block aligned above the drilling opening of the floor while allowing the crown block to travel upwardly and downwardly relative to the tower;

at least one pair of hydraulically operated linear actuators extending upwardly above the floor and each including an elongated hollow cylinder, an elongated rod member telescopically arranged within the cylinder, and means coacting between the cylinder and the rod member in piston fashion, the rod members having free end portions projecting from the respective cylinders, the cylinders having closed ends opposite the rod members, the linear actuators of each pair being located each on a different side of the drilling opening;

releasable means for securing one of (a) the free ends of the rod members and (b) the closed ends of the cylinders to the crown block, the other of (a) the free ends of the rod members and (b) the closed ends of the cylinders being secured to one of the substructure and an upper end portion of the tower to fix said other of the cylinders and the rod members against longitudinal movement relative to the combination of the substructure and the tower, whereby the crown block can be driven upwardly and downwardly by operation of the linear actuators;

reeving means mounted on the crown block and having four sets of reeving wheels, each set of reeving wheels comprising first and second reeving wheels having centers located on a first horizontal line perpendicular to a vertical plane formed by the longitudinal axes of the linear actuators and the well axis and located on one side of the vertical axis of the crown block, and a third reeving wheel located on the opposite side of the vertical axis of the crown block;

a travelling beam; and cable means comprising for each set of reeving wheels a first cable having one end connected to the substructure and extending upwardly, over the first reeving wheel and thence downwardly to the travelling beam, the other end of the first cable being secured to the travelling beam on the side thereof adjacent the first reeving wheel, and a second cable having one end connected to the substructure and extending upwardly, over both the second and third reeving wheels and thence downwardly to the travelling beam, the other end of the second cable being secured to the travelling beam on the side thereof diagonally opposite the location of the first cable, said one ends of the cables for the first and second sets of wheels being connected to the substructure on one side of the well axis, and said one ends of the cables for the third and fourth sets of wheels being connected to the substructure on the opposite side of the well axis;

said reeving wheels being arranged in a grid-like pattern when viewed from the top, said pattern comprising:

a first column including the first and second reeving wheels of said first set and said second set of reeving wheels;

a second column adjacent the first column and including the third reeving wheels of the third and fourth sets of reeving wheels;

a third column adjacent the second column and including the third reeving wheels of the first and second sets of reeving wheels;

a fourth column adjacent the third column and including the first and second reeving wheels of the third and fourth sets of reeving wheels;

a first row including the first reeving wheels of said first and third sets of reeving wheels;

a second row adjacent the first row and including the second and third reeving wheels of said second and fourth sets of reeving wheels;

a third row adjacent said second row and including the first reeving wheels of said second and fourth sets of reeving wheels;

a fourth row adjacent said third row and including the second and third reeving wheels of said first and third sets of reeving wheels;

said rows being perpendicular to said columns;

the centers of all of said reeving wheels being in a common horizontal plane.

* * * * *